US008944865B1

(12) United States Patent
Krabacher et al.

(10) Patent No.: US 8,944,865 B1
(45) Date of Patent: Feb. 3, 2015

(54) WATER SENSING INTERLOCK SYSTEMS AND METHODS FOR HYBRID MARINE VESSELS

(71) Applicant: Brunswick Corporation, Lake Forest, WI (US)

(72) Inventors: Matthew S. Krabacher, North Fond du Lac, WI (US); Peter A. Chisholm, North Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 144 days.

(21) Appl. No.: 13/748,695

(22) Filed: Jan. 24, 2013

(51) Int. Cl.
*B63H 21/21* (2006.01)

(52) U.S. Cl.
CPC ..... *B63H 21/21* (2013.01)
USPC ..... 440/1

(58) Field of Classification Search
USPC ..... 440/1, 85; 114/183 R, 382
See application file for complete search history.

(56) References Cited

U.S. PATENT DOCUMENTS

| | | | |
|---|---|---|---|
| 4,050,396 | A | 9/1977 | Ridgeway |
| 4,697,535 | A | 10/1987 | Wileman, III |
| 5,516,312 | A | 5/1996 | Reed |
| 5,947,047 | A | 9/1999 | Sigler |
| 7,661,380 | B2 | 2/2010 | Waldecker |

OTHER PUBLICATIONS

Hybrid Electric Vehicle Technology, PowerPoint Presentation, Chapter 3—High-Voltage Vehicle Safety Systems, 2010 by American Technical Publishers, Inc., 19 pages.

*Primary Examiner* — Lars A Olson
(74) *Attorney, Agent, or Firm* — Andrus Intellectual Property Law LLP

(57) ABSTRACT

A system for controlling power in a hybrid marine vessel arrangement. A first water sensor senses a presence of water at a first location on the marine vessel. An intermediate switch is activated when the first water sensor senses the presence of water at the first location. An interlock switch disconnects power to at least one high voltage electrical component on the marine vessel when the intermediate switch is activated.

18 Claims, 6 Drawing Sheets

WATER SENSING INTERLOCK SYSTEMS AND METHODS FOR HYBRID MARINE VESSELS

FIELD

The present disclosure relates to electrical systems for hybrid marine vessels.

BACKGROUND

U.S. Pat. No. 4,050,396 discloses a portable water bailing device including a housing having a plurality of openings therein adjacent the lower end thereof. Within the housing is a water pump connected to a tube for directing the water from the bottom of the boat outwardly over the edges thereof. The water pump is driven by a direct current motor which is connected in series with a battery. Also in series with the battery and motor is a limit switch which is actuated by a float within the housing. As the water rises within the housing, the float actuates the switch which in turn actuates the pump.

U.S. Pat. No. 4,697,515 discloses a marine safety system comprising a first switch adapted to be activated by rising water in a ship's hull, and solenoid valves adapted to be operated by the switch and adapted to close sea cocks in the hull of the ship in a preferred sequence.

U.S. Pat. No. 5,516,312 discloses a device for sensing the presence of hull water above an acceptable level in the hull of a boat and communicating to any combination of ignition, starter, aural and/or visible means in such manner as to cause the boats engine to stop running and apprise the boat operator as to the presence of excessive hull water.

U.S. Pat. No. 5,947,047 discloses a boat that has a seacock operatively attached to the hull and movable between open and closed positions. The seacock is operatively connected to a discharge pump, which in turn is connected to a sewage holding tank. An electrical switch is actuated in response to the position of the seacock, and control circuitry is connected to the seacock electrical switch and the discharge pump to prevent operation of the pump if the seacock is closed (or in any position aside from fully open). An indicator, such as one or more light emitting diodes, is also actuated in response to the seacock electrical switch position, and another indicator, such as one or more light emitting diodes, is connected to the discharge pump and indicates when that pump is operating. The electrical switch is waterproof and meets marine vessel ignition prevention and electromagnetic compatibility requirements, and typically is actuated in response to the position of a manually actuable (e.g. rotatable) handle of the seacock.

U.S. Pat. No. 7,661,380 discloses an improved bilge water level monitor, alert and control system for boats and other vessels. The system provides a method of detecting excessive leakage of water into the bilge and in response to the excessive water in the bilge, triggering an alarm to notify the operator and others and energizes bilge pumps to remove the excessive water. The system is designed with many redundancies in the sub elements and subsystems for safety. The system provides a means for reducing the likelihood of exhausting battery power in the event of a significant seawater leakage problem. The electrical power rating of the monitoring circuitry components is relatively low, thereby reducing the size and weight of those components relative to prior bilge pump monitoring and alert systems. There is no electrical wiring exposed to bilge water during system operation thereby reducing damage to the wiring components. The water level detection and control circuitry operates with sufficiently low amperage to substantially eliminate the hazard of spark-induced combustion.

Abandoned U.S. patent application Ser. No. 11/505,075, expressly incorporated herein in entirety by reference, discloses hybrid marine propulsion systems that connect both an internal combustion engine and an electric motor to a propeller in torque-transmitting relation so that the propeller can selectively receive a sum of the torque provided by the engine and the motor.

U.S. patent application Ser. No. 11/505,075, expressly incorporated herein in entirety by reference, discloses systems and methods for charging a rechargeable battery device on a marine vessel utilize a rechargeable battery device, a charger charging the battery device, and a control circuit. The control circuit calculates an amount of current that is available to charge the battery device based upon an amount of current that is available from the shore power source and an amount of current that is being drawn from the shore power source by devices other than a voltage charger and limits the amount of current being drawn by the voltage charger to charge the battery device to an amount that is equal to or less than the calculated amount of current that is available to charge the battery device. The control circuit can repeatedly calculate the amount of current that is available to charge the battery device and limit the amount of current being drawn by a voltage charger to charge the battery device to thereby actively adjust an amount of charge applied to the battery device.

U.S. patent application Ser. No. 13/100,037, expressly incorporated herein in entirety by reference, discloses systems and methods of operating a marine propulsion system utilize an internal combustion engine and an electric motor that is powered by a battery, wherein the internal combustion engine and the electric motor each selectively power a marine propulsor to propel a marine vessel. A control circuit is operated to control operation of the system according to a plurality of modes including at least an electric mode wherein the electric motor powers the marine propulsor and a hybrid mode wherein the internal combustion engine powers the marine propulsor and provides power for recharging the battery. An operator-desired future performance capability of the hybrid marine propulsion system is input to the control circuit, which selects and executes the plurality of modes so as to provide the operator-desired desired future performance capability.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A system for controlling power in a hybrid marine vessel arrangement is disclosed. The system includes a first water sensor that senses a presence of water at a first location on the marine vessel. An intermediate switch is activated when the first water sensor senses the presence of water at the first location. The system also includes an interlock switch that disconnects power to at least one high voltage electrical component on the marine vessel when the intermediate switch is activated.

A method for controlling power in a hybrid marine vessel arrangement is also disclosed. The method includes sensing a presence of water at a first location on the marine vessel with a first water sensor. The method further includes electrically opening an interlock switch when the presence of water is sensed at the first location to thereby disconnect power to at least one high voltage electrical component on the marine vessel.

BRIEF DESCRIPTION OF DRAWINGS

Examples of systems and methods for controlling power in a hybrid marine vessel arrangement are described with reference to the following Figures. The same numbers are used throughout the Figures to reference like features and like components.

DETAILED DESCRIPTION OF DRAWINGS

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims. Each limitation in the appended claims is intended to invoke interpretation under 35 USC §112, sixth paragraph, only if the terms "means for" or "step for" are explicitly recited in the respective limitation.

Figure 1:
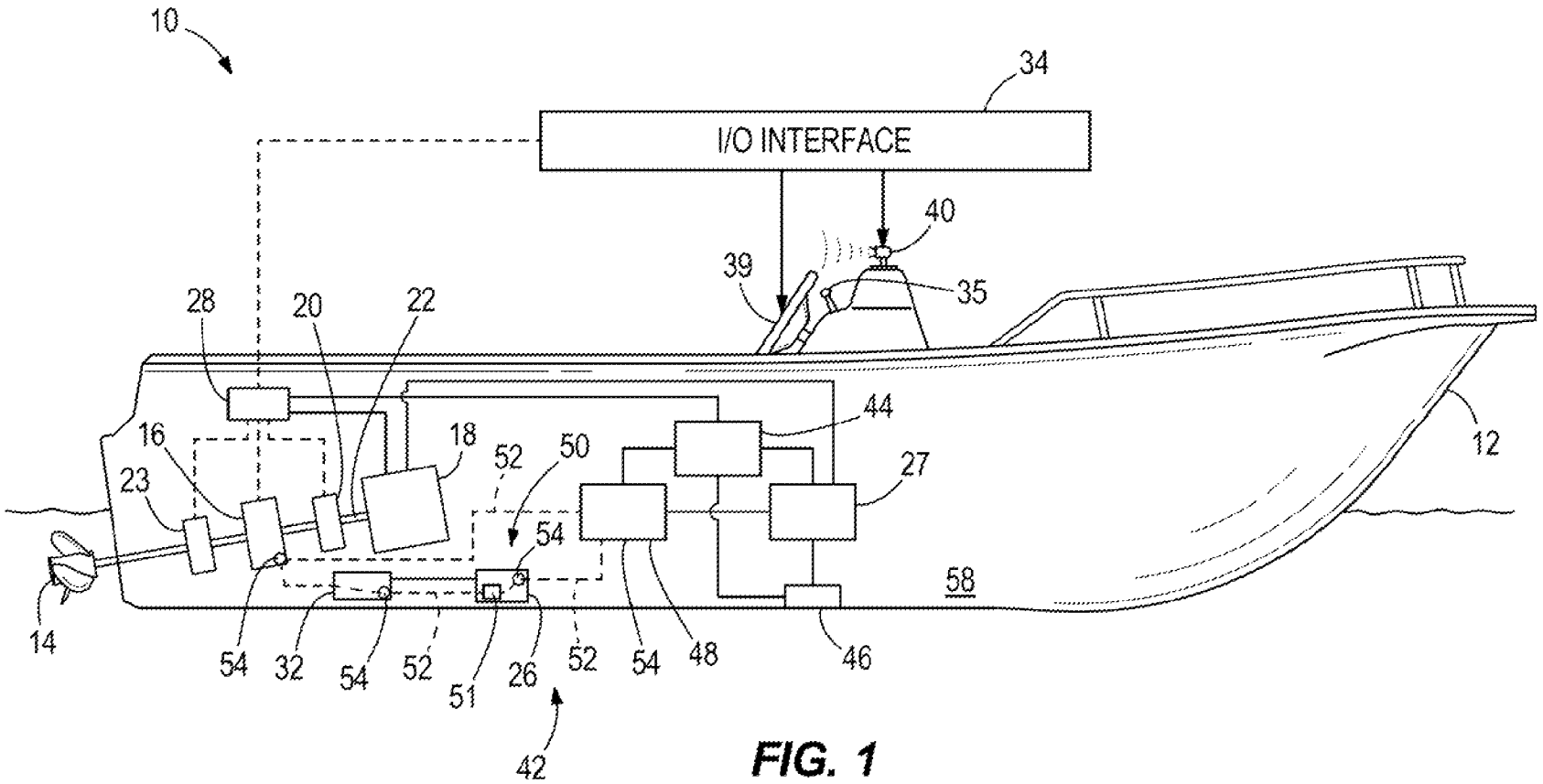
FIG. 1 is a schematic view of a hybrid marine vessel.
Figure 2:
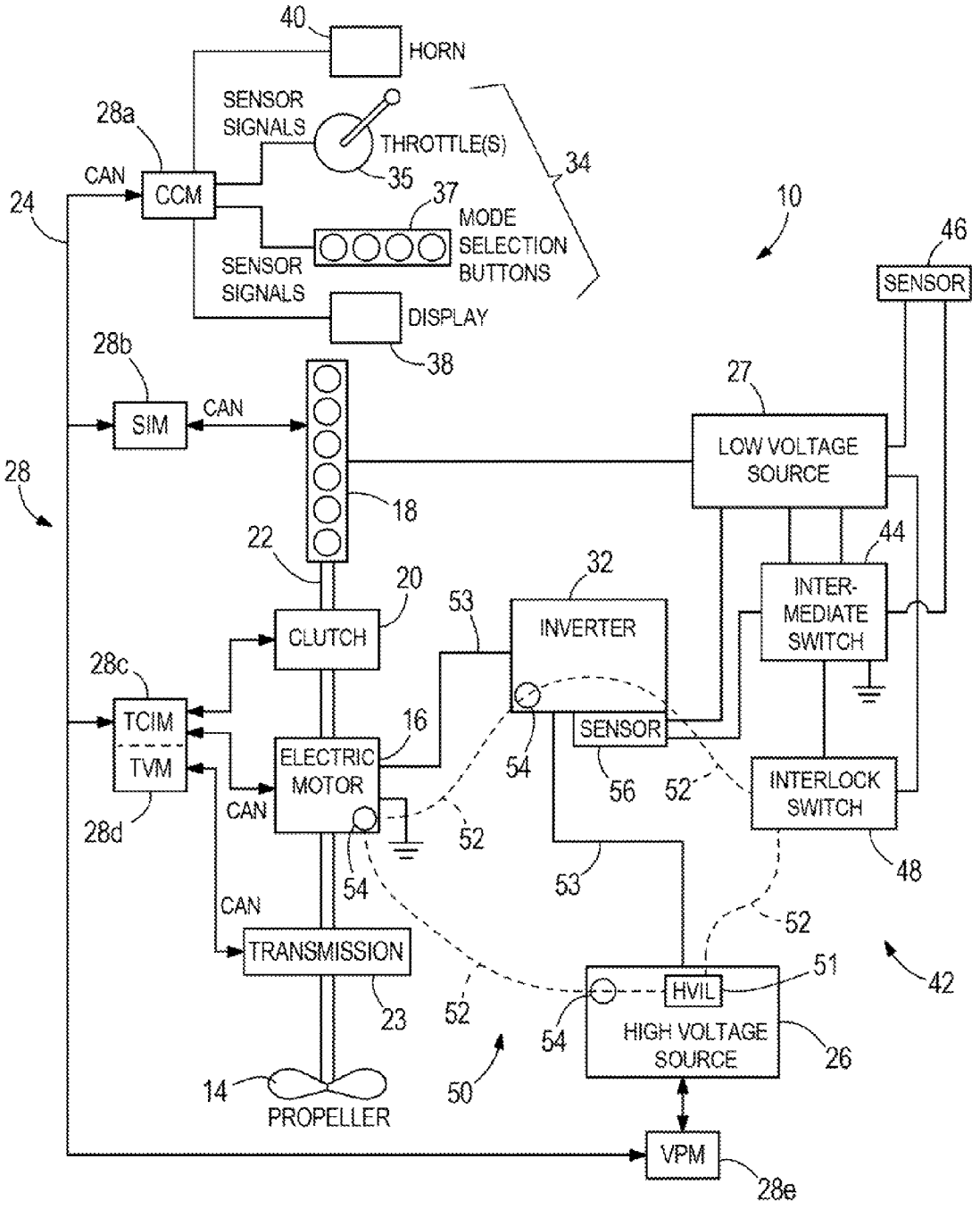
FIG. 2 is a schematic view of a control system for a hybrid marine vessel.

FIGS. 1 and 2 depict a hybrid marine propulsion system 10 for a marine vessel 12.

The system 10 includes among other things one or more propulsors 14 (collectively referred to herein as "propulsor"), which can include any type of device for propelling the marine vessel 12 including but not limited to one or more propellers (as shown in FIG. 1), impellers, stern drives, pod drives, and/or the like. The propulsor 14 is selectively driven by one or more electric motors 16 (collectively referred to herein as "motor"), one or more internal combustion engines 18 (collectively referred to herein as "engine"), and a combination of the motor 16 and engine 18. In the example shown, the system 10 also includes one or more clutches 20 (collectively referred to herein as "clutch") for selectively connecting and disconnecting the engine 18 from a driveshaft 22 that extends from the engine 18 to a transmission 23 for driving the propulsor 14. The engine 18 can include a diesel engine or any other type of engine for rotating the driveshaft 22 and thereby providing power to the propulsor 14. The clutch 20 can include any type of clutch for connecting and disconnecting the engine 18 and driveshaft 22, such as for example a friction clutch, or more preferably a dog clutch because the speeds of the motor 16 and engine 18 are typically synchronized (i.e. substantially matched) before the clutch 20 is engaged or disengaged.

The motor 16 is located between the clutch 20 and transmission 23 and drives driveshaft 22 at the same time or separately from the engine 18. In the example shown, the driveshaft 22 extends through and forms a part of the motor 16; however, arrangements where the motor 16 and driveshaft 22 are separate components are also contemplated and should be considered part of this disclosure. For example, the motor 16 could be linked in torque transmitting relation with the drive shaft 22 via a gearbox containing for example planetary gears, sun gears, and/or ring gears. Together, the engine 18, clutch 20, motor 16 and transmission 23 provide forward, neutral, and reverse operations of propeller 14 in a "parallel" hybrid drive arrangement; however it should be recognized that the examples shown and described are not limiting and that the concepts discussed and claimed herein are applicable to other types of parallel and non-parallel hybrid marine propulsion configurations. For example, in a parallel hybrid drive arrangement, generally the engine 18 is a primary source of torque to drive the propulsor 14 and the motor 16 is used as a co-primary or a secondary source of torque to drive the propulsor 14. Alternatively, in a series hybrid drive arrangement, generally the motor 16 is the primary source of torque to drive the propulsor 14 and the engine 18 is typically used principally or solely to drive an electrical generator that supplies electrical energy to a battery and the motor 16.

The system 10 also includes a controller 28 operatively connected to each of the motor 16, engine 18, clutch 20 and transmission 23. The controller 28 is also operatively connected to an input/output interface 34. As shown in FIG. 1, the input/output interface 34 includes various components, including but not limited to a horn 40, a steering wheel 39, and a throttle 35. The input/output interface 34 may also include a plurality of mode selection buttons 37 and a display 38, as shown in FIG. 2. Interaction between the controller 28 and these components will be further described herein below.

The system 10 also includes a high voltage power source 26, which may include one or more high voltage rechargeable storage batteries. As used herein, the term "high voltage" refers to any voltage above 50 volts and the term "low voltage" refers to any voltage below 50 volts, as defined by the Occupational Safety and Health Administration (OSHA), Standard E-11 of the American Boat & Yacht Council (ABYC), and Standard 10133 of the International Organization for Standardization (ISO). Various other definitions of "high voltage" and "low voltage" are possible depending on the application and the standards required for such an application, and the terms are therefore not meant to limit the scope of the present claims. The high voltage power source 26 is connected in electrical communication with the motor 16 and can discharge current to power the motor 16 or can be supplied with current by the motor 16 acting as a generator. In this arrangement, the motor 16 is connectable in torque transmitting relation with, and driven by, the engine 18, which in turn provides a supply of current for recharging high voltage power source 26. The system 10 can also be provided with a low voltage power source 27, including one or more low voltage rechargeable storage batteries which can also be supplied with current by the motor 16 acting as generator. In the embodiment shown, the high voltage power source 26 and low voltage power source 27 are provided by separately-located banks of batteries; however, the high voltage power source 26 and low voltage power source 27 could be provided in the same location by one power source that includes both a high voltage battery and a low voltage battery and/or a DC/DC converter for converting a high voltage to a low voltage. The high voltage power source 26 is electrically connected to the motor 16 via an inverter 32, which converts DC electricity from the high voltage power source 26 into AC electricity usable by the motor 16. Although not shown herein, the low voltage power source 27 is electrically connected to the controller 28 and various other components such as the horn 40, steering wheel 39, and throttle 35.

A system 42 for controlling power in the hybrid marine vessel 12 is also provided. The system 42 for controlling power comprises at least one water sensor, such as first water sensor 46, an intermediate switch 44, and an interlock switch 48. The system 42 for controlling power further comprises an interlock circuit 50. The interlock circuit 50 comprises a high voltage interlock loop (HVIL) control circuit 51 provided at the high voltage power source 26. Alternatively, the HVIL control circuit 51 could be provided elsewhere, such as at transmission/engine controller (SIM) 28*b* (see FIG. 2). As described herein above, the high voltage power source 26 provides high voltage power (for example, above 50 volts) to at least one high voltage electrical component on the marine vessel 12, including but not limited to motor 16. Other components aboard the marine vessel 12 that are provided with high voltage power and that may optionally be wired into the interlock circuit 50 include generating sets, high voltage switchboards with associated switchgear, protection devices and instrumentation, high voltage/low voltage step-down transformers to service low voltage consumers, high voltage/high voltage step-down transformers supplying propulsion converters and motors, and/or high voltage motors for thrusters, air conditioning and compressors.

High voltage power is provided to these components via electrical cables 53, each electrical cable 53 being capable of carrying sufficient electrical energy to power the high voltage electrical components. The HVIL control circuit 51 is serially electrically connected to a plurality of HVIL switches 54 using a plurality of wire cables 52. An HVIL switch 54 is provided at each of the components that are to be included in the interlock circuit 50. The interlock circuit 50 therefore is formed by wiring together high voltage components aboard the marine vessel 12 (including but not limited to inverter 32, motor 16, and high voltage power source 26) by connecting HVIL switches 54 in series via wire cables 52. When one of the HVIL switches 54 is opened, such as by removing a cover on the associated high voltage electrical component, the interlock circuit 50 is broken. Similarly, when the interlock switch 48 is opened, as described further herein below, the interlock circuit 50 is broken. Such a condition is detected by the HVIL control circuit 51, which responds by disconnecting power provided via the electrical cables 53 to each of the high voltage components in the interlock circuit 50.

FIG. 1 depicts an inboard/outboard marine arrangement; however the concepts disclosed in this application are applicable to any type of marine propulsion system, such as for example an outboard motor arrangement.

Referring to FIG. 2, the systems 10 and 42 will be more fully described. The controller 28 is connected to a serial communication bus, such as a controller area network 24 (CAN) for passing information between devices in the system 10 to thereby operate the system 10 in a plurality of operational modes. The controller 28 is shown schematically and includes a plurality of controller sections 28*a*-28*e*, each section having a processor or CPU communicatively connected to a computer readable medium that includes volatile or non-volatile memory upon which computer readable code is stored. Each processor accesses the computer readable code and the computer readable medium upon executing the code carries out the functions as described herein below. It is to be understood that the computer readable medium may be separate from the processor, a part of the processor, or integrally connected to the processor, while in still further embodiments the computer readable medium may be implemented as a plurality of computer readable media for access by the processor. Each processor sends and receives electronic control signals, communicates with other processors in the controller area network 24, and controls operations of a certain component in the system 10 such as the engine 18, clutch 20, or motor 16. The programming and operations of the controller 28 and its sections 28*a*-28*e* are described in further detail below with respect to non-limiting examples and/or algorithms. While each of these examples/algorithms includes a specific series of steps for accomplishing certain system control functions, the scope of this disclosure is not intended to be bound by the literal order or literal content of steps described herein, and non-substantial differences or changes still fall within the scope of the disclosure. Also, the configuration of the controller area network 24, controller 28, and sections 28*a*-28*e* can vary significantly. For example, the controller 28 does not need to include separately located sections and can instead comprise a single control device with a single processor located at one location. Conversely the controller 28 can include more sections than those shown and sections located at different locations than those shown.

In the example shown, the controller 28 includes a command control section 28*a* (CCM) that receives user inputs via the controller area network 24 from a user input/output interface 34. The user input/output interface 34 is shown in FIG. 1 includes a conventional throttle 35 and steering wheel 39 and in FIG. 2 includes a plurality of mode selection buttons 37 and a display 38; however, the user input/output interface 34 is not limited to these configurations and can additionally or alternately comprise other devices for inputting commands to the system 10, such as fewer or more input keys than that shown, or joysticks, touch screens, and/or the like. Actuation of the user input/output interface 34 is sensed by sensors (not shown) and communicated to command control section 28*a* via the controller area network 24.

The command control section 28*a* is programmed to convert the user inputs into electronic commands and then send the commands to other controller sections in the system 10. These other controller sections include a transmission/engine controller (SIM) 28*b* that controls engine/transmission/shifting and reads signals regarding transmission state and output speed; a thermal, clutch motor interface module (TCIM) 28*c* that controls the cooling system and clutch 20, and provides communication interface between the controller area network 24 and a controller section (not shown) for the motor 16; and a drive control module (TVM) 28*d* that receives commands from the command control section 28*a* and controls for example a pod drive to a particular steering angle. Again, the controller area network 24 shown in FIG. 2 is exemplary and could be significantly changed and still fall within the scope of the present disclosure and achieve the system functional activities set forth herein.

During operation of the marine vessel 12, the controller 28 is programmed to switch amongst three primary modes of control, namely (1) an Engine Mode, wherein the engine 18 is connected to the propulsor 14 by the clutch 20 and all of the driving force to the propulsor 14 is provided by the engine 18; (2) an Electric Mode, wherein the motor 16 is connected to the propulsor 14 and all of the driving force to the propulsor 14 is provided by the motor 16; and (3) a Hybrid Mode wherein both the engine 18 and the motor 16 are connected to the propulsor 14 and the driving force to the propulsor 14 is provided by a combination of the engine 18 and the motor 16. Also, as discussed above, when the engine 18 is providing output to the system 10, the controller 28 can operate a Charge Mode wherein the motor 16 is controlled to perform as a generator, thereby providing a recharge current to the high voltage power source 26 and/or low voltage power source 27. Charge Mode typically occurs during Hybrid Mode operation, for example, when both the motor 16 and engine 18 are connected in parallel via the driveshaft 22. Which mode of operation is utilized at any given time can depend upon the specific operating conditions of the vessel 12 or can be based upon user inputs provided by the user input/output interface 34.

The system 10 disclosed herein provides switching between the various modes of operation while the engine 18 is running and/or while the motor 16 is running and with the propulsor 14 in neutral or in gear. For example, it is often desirable to switch into Electric Mode when operating the vessel 12 at low speeds to thereby provide quieter vessel operation and more fuel-efficient vessel operation. It is often desirable to switch into Hybrid Mode, and more specifically Charge Mode, when the power of the high voltage source 26 and/or low voltage source 27 is low to thereby draw recharging current from the engine 18. A controller section referred to as a vessel power module 28*e* (VPM) controls charging and discharging of the high voltage power source 26 and optionally the low voltage power source 27, although not shown herein.

Regarding the system 42 for controlling power, a first water sensor 46 can be provided in the bilge 58 (FIG. 1) of the marine vessel 12, where collection of water could be detrimental to high voltage electrical components and/or an operator of the marine vessel 12. As can be seen in FIG. 2, the electric motor 16 is connected to the high voltage power source 26 via the inverter 32, the housing of which is provided with a second water sensor 56. The second water sensor 56 senses whether water is present in the housing of the inverter 32, which could be detrimental to an operator of the marine vessel 12 as well. Both the first water sensor 46 and the second water sensor 56 are electrically connected to the intermediate switch 44. The intermediate switch 44 is in turn electrically connected to the interlock switch 48. The low voltage power source 27 selectively provides current to each of the intermediate switch 44, the first and second water sensors 46, 56, and the interlock switch 48 as will be described further herein below. As in FIG. 1, the high voltage power source 26, inverter 32, and motor 16 are provided with HVIL switches 54 connected by wire cables 52 with the interlock switch 48 and the HVIL control circuit 51 to form an interlock circuit 50. When one of these HVIL switches 54 or interlock switch 48 is opened, the system 42 for controlling power disconnects power provided via electrical cables 53 to these components. Although not shown here, other high voltage components aboard the marine vessel 12 (such as those listed herein above) can be wired into the interlock circuit 50 via wire cables 52 and HVIL switches 54.

Figure 3:
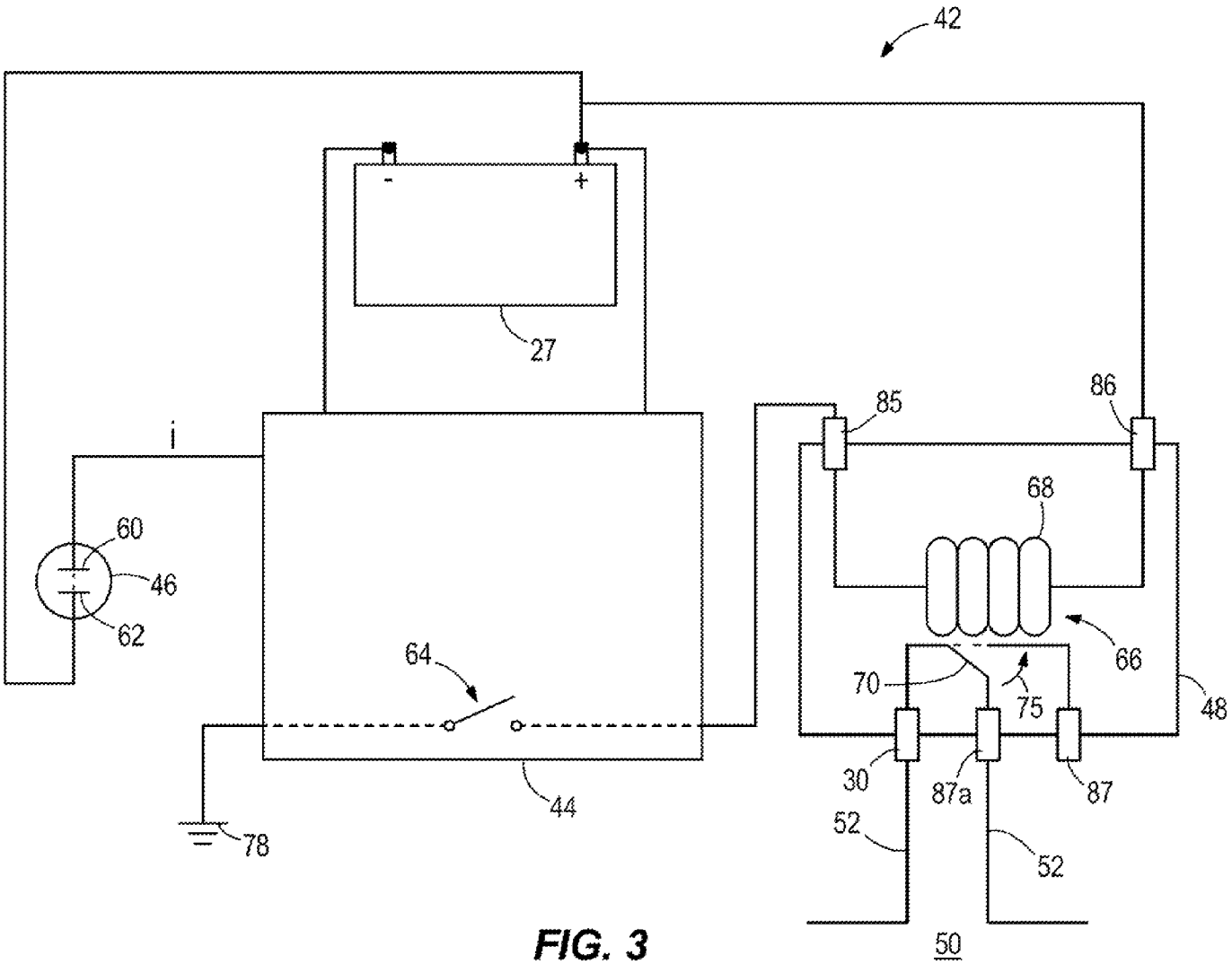
FIG. 3 is a first embodiment of a system for controlling power in a hybrid marine vessel.

Now with reference to FIG. 3, details of the system 42 for controlling power will be further described. As mentioned herein above, the system 42 for controlling power comprises a water sensor, such as the first water sensor 46, an intermediate switch 44, and an interlock switch 48. Each of the first water sensor 46, intermediate switch 44, and interlock switch 48 are electrically connected to the low voltage power source 27, in this example a 12 volt battery.

In the embodiment shown, the first water sensor 46 is a two-wire device with no moving parts and has two probes 60, 62; however, the first water sensor could also be a single probe device. Some examples of suitable water sensors include a two probe threaded sensor provided by Mercury Marine, part number 889330 S.S. to 8M0021043 (Parker/Racor Filtration part number 10558); a two probe molded in housing sensor provided by Mercury Marine, part number 892242T S.S. to 8M0020346 S.S. to 8M0060042; or a single probe sensor provided by Mercury Marine, part number 828586 S.S. to 828586 1. The probes 60, 62 can for, example, be nickel-gold plated probes. In the embodiments shown, one of the probes 60 is electrically connected to the intermediate switch 44, while the other probe 62 is electrically connected to the low voltage power source 27. When no water is present near the first water sensor 46, there is relatively little conduction between the two probes 60, 62. However, when water is present near the first water sensor 46, current (hereinafter referred to as a "control signal i") is conducted from the probe 62 to the probe 60. The control signal i is input to the intermediate switch 44. Once a threshold input (which threshold is pre-determined by the specifications of the intermediate switch 44) is provided to the intermediate switch 44, intermediate switch 44 is activated. In one embodiment, for example, the intermediate switch 44 comprises a solid state relay and the control signal i activates a coupling mechanism 64, to "close" the normally open intermediate switch 44. The intermediate switch 44 can be a solid state relay, but can alternatively be any type of electronic switching device. For example, the intermediate switch 44 could be an insulated-gate bipolar transistor (IGBT), a MOSFET, or a transistor.

The interlock switch 48 also comprises an electronic switching device. For example, the interlock switch 48 can be a solid state relay, a MOSFET, an IGBT, or a transistor. In the present embodiment, the interlock switch 48 is an electromagnetic relay 66. The electromagnetic relay 66 comprises an electromagnet 68 and an armature 70. One end of the electromagnet 68 is electrically connected to pin 86 of the interlock switch 48. Pin 86 is in turn electrically connected to the low voltage power source 27. The other end of the electromagnet 68 is connected to pin 85 of the interlock switch 48. Pin 85 is in turn connected to the intermediate switch 44. The armature 70 in the interlock switch 48 is in a normally closed position, i.e., the armature 70 connects pins 30 and 87*a*. Pin 30 is in turn connected to one end of the interlock circuit 50 through the wire cable 52. Pin 87*a* is in turn connected to the other end of the interlock circuit 50 through wire cable 52 as well. Therefore, when the electromagnet 68 is not energized, armature 70 remains in the normally closed position, completing the interlock circuit 50. The HVIL control circuit 51 (FIGS. 1 and 2) detects the closed state of the interlock circuit 50, and controls the high voltage power source 26 to provide power to the high voltage components aboard the marine vessel 12 via the electrical cables 53.

When the first water sensor 46 senses the presence of water, the resistance between probes 60 and 62 is reduced, and current is conducted from the low voltage power source 27 across the probes 62, 60. The control signal i is thereby provided to the intermediate switch 44, activating and closing the coupling mechanism 64. When the coupling mechanism 64 closes, pin 85 on the interlock switch 48 is thereby connected to ground 78 via the intermediate switch 44. Grounding pin 85 of the interlock switch 48 causes current to flow through the electromagnet 68 from the low voltage power source 27. Current is conducted from the low voltage power source 27 through pin 86 to one end of the electromagnet 68 and then through pin 85 to ground 78 via the coupling mechanism 64. When current flows through the electromagnet 68, the armature 70 is attracted by the electromagnet 68 and therefore switches from the normally closed position (connecting pins 30 and 87*a*) to the open position (shown in dashed lines), as shown by arrow 75. This connects pin 30, and therefore one end of the interlock circuit 50, to pin 87, which is not wired in series with the remainder of the interlock circuit 50. Therefore, the continuity of the interlock circuit 50 is broken and the HVIL control circuit 51 disconnects power to the high voltage electrical components as described herein above.

Figure 4:
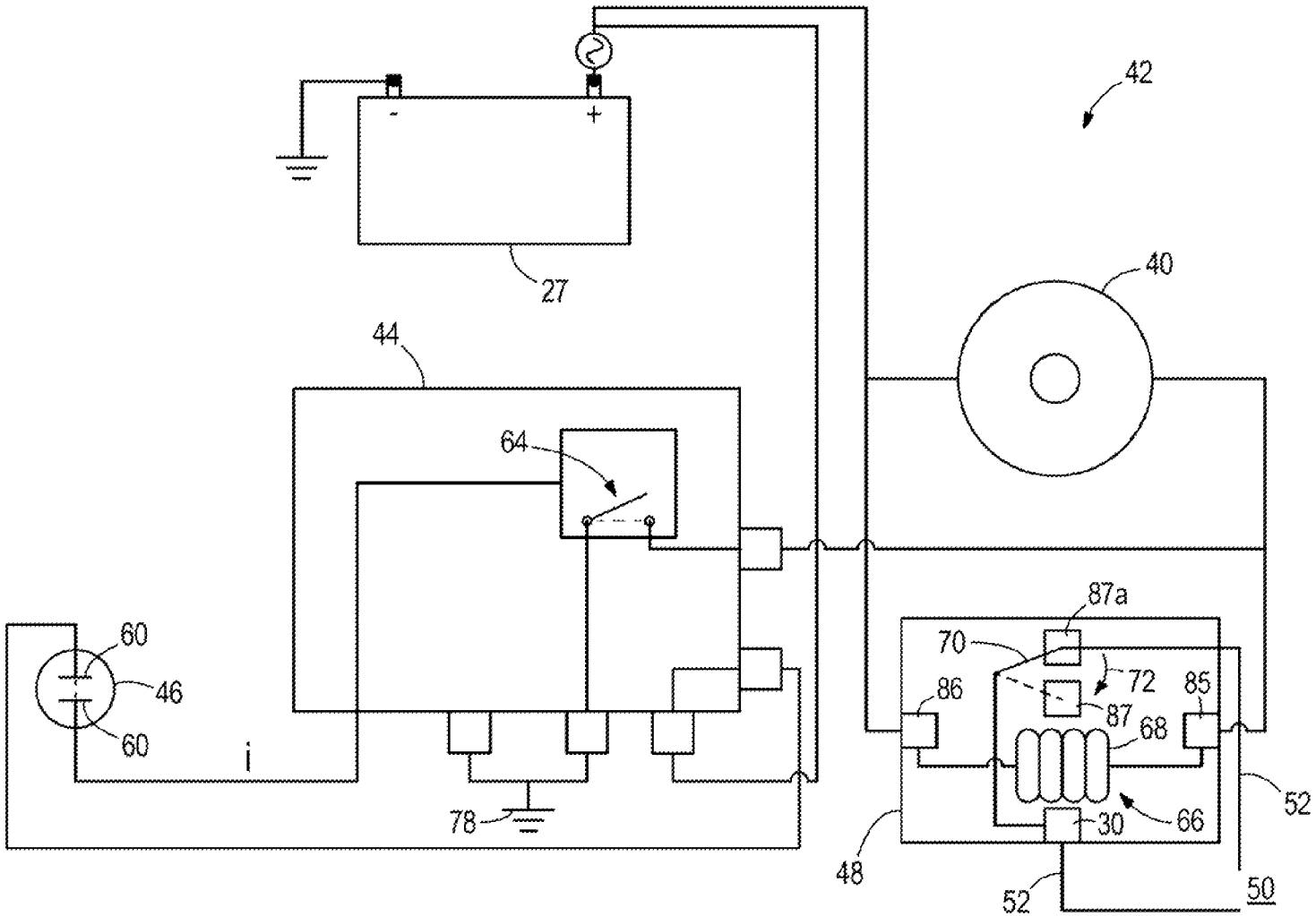
FIG. 4 is a second embodiment of a system for controlling power in a hybrid marine vessel.

FIG. 4 depicts a second embodiment of the system 42 for controlling power in a hybrid marine vessel arrangement. This embodiment is similar to that shown in FIG. 3, except for the inclusion of a horn 40. When the first water sensor 46 senses water, current i is conducted between the probes 60, 62, and the coupling mechanism 64 in the intermediate switch 44 is closed as described above. Closing the coupling mechanism 64 provides a connection to ground 78, thereby completing a circuit with the horn 40. Providing current to the horn 40 sounds the horn 40 to alert an operator of the marine vessel 12 that water has been sensed by the first water sensor 46 and that the interlock circuit 50 has therefore been broken, disconnecting power to at least one high voltage electrical component on the marine vessel 12. In other words, closing coupling mechanism 64 both causes the horn 40 to sound and the interlock circuit 50 to be broken.

Figure 5:
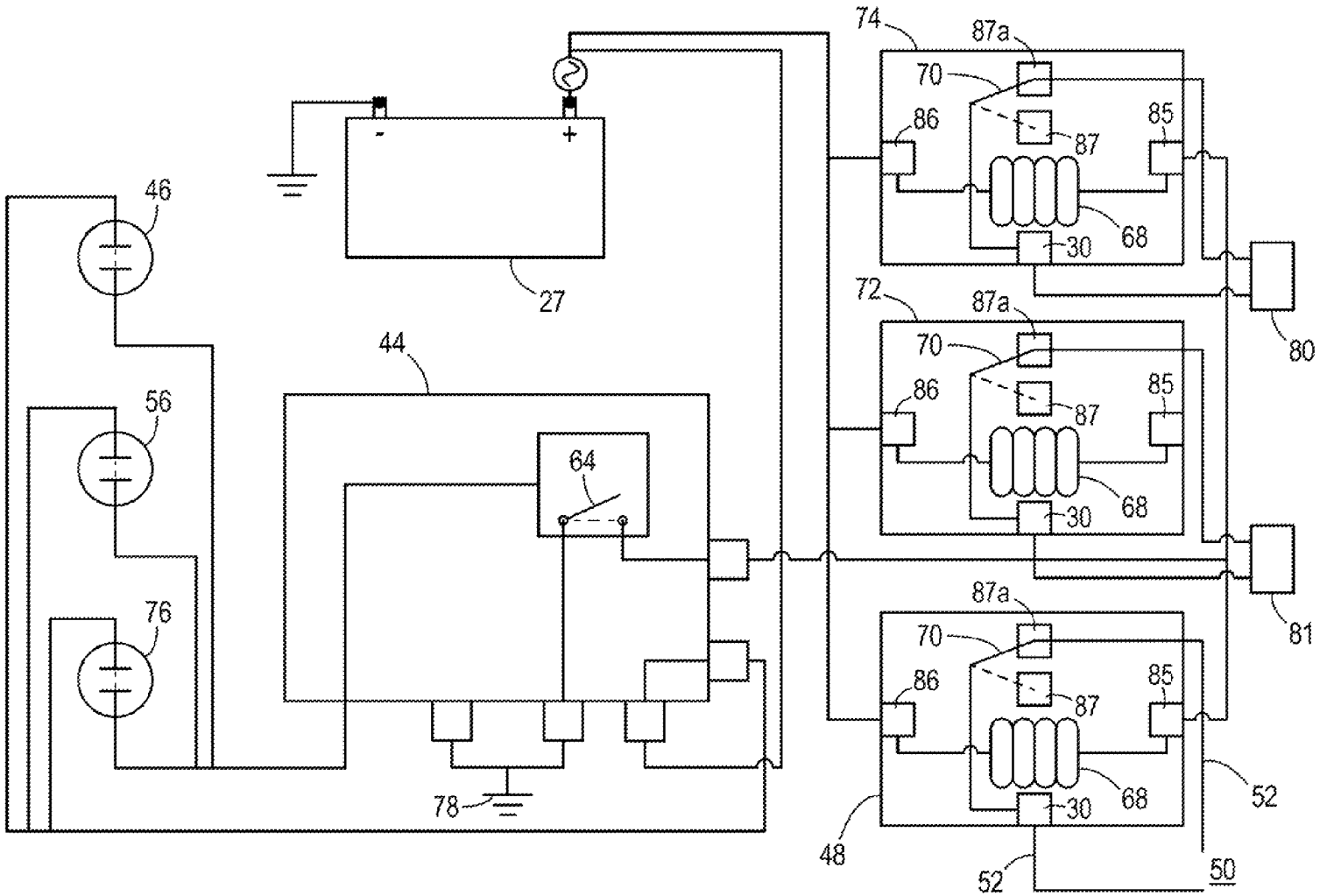
FIG. 5 is a third embodiment of a system for controlling power in a hybrid marine vessel.

FIG. 5 depicts a system much like those shown in FIGS. 3 and 4. In FIG. 5, a plurality of water sensors 46, 56, 76 are provided. For example, the first water sensor 46 is provided in the bilge 58. The second water sensor 56 is provided in the housing of the inverter 32. A third water sensor 76 can be provided anywhere where it is undesirable to have water in close contact with high voltage electrical components.

With further reference to FIG. 5, a plurality of switches are also provided. For example, an interlock switch 48 can be provided to disconnect electrical power to one or more high voltage electrical components aboard the marine vessel 12. Another switch 72 can be provided to shut down the engine 18, such as for example by interrupting power to spark plugs 81 in a gasoline engine or shutting off flow of fuel to a fuel injection pump in a diesel engine. Another switch 74 can be provided to turn on a pump 80 located in the bilge 58 of the marine vessel 12. It should be understood that the switches 72, 74 need not provide these specific functions but could provide other functions that may be desirable when water is sensed in a certain location aboard a marine vessel 12. Further, it should be noted that each of the switches 48, 72, 74 need not be electromagnetic relays 66 as shown in FIG. 5, but could comprise any other type of electronic switches. Further, it should be understood that each of these switches 48, 72, 74 need not be wired as normally closed switches, but may instead be wired as normally open switches that close when the presence of water is sensed by one or more of the water sensors 46, 56, 76. For example, for the switch 74 designed to turn on a pump in the bilge 58, the armature 70 could be normally connected to pin 87, thereby not providing power to the pump 80 in the bilge 58. When the coupling mechanism 64 closes in response to a current i, current passing through the electromagnet 68 in the switch 74 could then move the armature 70 to pin 87*a*. Doing so would close the switch 74 and provide power to the pump 80 in the bilge 58.

Therefore, according to the embodiment of FIG. 5, when water is sensed by any of the water sensors 46, 56, 76, interlock switch 48 disconnects power to at least one high voltage electrical component on the marine vessel 12, switch 72 shuts down engine 18, and switch 74 turns on a pump 80 in the bilge 58. Although not shown herein, the system 42 for controlling power could be designed such that a signal i from first water sensor 46 in the bilge 58 activates only interlock switch 48 (to disconnect power to high voltage electrical components) and switch 74 (to turn on the pump 80 in the bilge 58). Similarly, the system 42 for controlling power could be designed such that a signal i from second water sensor 56 in the housing of the inverter 32 activates only interlock switch 48 (to disconnect power to high voltage electrical components) and switch 72 (to shut down the engine 18). In this way, the circuits can be separated from one another such that the pump 80 in the bilge 58 is not operating when no water has been sensed there.

In each of the embodiments of FIGS. 3-5, although power to at least one high voltage electrical component aboard the marine vessel 12 is disconnected when water is sensed by any one of the water sensors 46, 56, 76, auxiliary components that run off power from low voltage power source 27 remain unaffected. This way, a user can still perform various functions aboard the marine vessel 12, such as use a radio to call for help, start the engine 18, operate a pump 80 in the bilge 58, or sound a horn 40, as described herein above.

Now, with reference to each of FIGS. 1-5, a system for controlling power in a hybrid marine vessel 12 arrangement is provided. The system comprises a first water sensor 46 that senses a presence of water at a first location on the marine vessel 12. The system further comprises an intermediate switch 44 that is activated when the first water sensor 46 senses the presence of water at the first location and an interlock switch 48 that disconnects power to at least one high voltage electrical component 16, 26, 32 on the marine vessel 12 when the intermediate switch 44 is activated. An interlock circuit 50 is formed by the at least one high voltage electrical component 16, 26, 32 being wired in series with the interlock switch 48. The interlock switch 48 is normally closed so as to complete the interlock circuit 50 and connect power to the at least one high voltage electrical component 16, 26, 32. In one embodiment, activating the intermediate switch 44 comprises closing the intermediate switch 44 so as to provide a current to the interlock switch 48. In one embodiment, the interlock switch 48 comprises an electromagnetic relay 66, and the current provided to the interlock switch 48 activates the electromagnetic relay 66 to open the interlock switch 48. In some embodiments, the intermediate switch 44 comprises a solid state relay.

The system may further comprise a safety switch that performs a safety function aboard the marine vessel, the safety switch being activated by the closing of the intermediate switch 44. In some embodiments, the safety function may comprise sounding a horn 40.

The system may further comprise a second water sensor 56 that senses a presence of water at a second location on the marine vessel 12. The intermediate switch 44 may be activated when the second water sensor 56 senses the presence of water at the second location. The system 10 may further comprise an inverter 32 and the first location may be a housing of the inverter 32 and the second location may be a bilge 58 of the marine vessel 12. The system may further comprise at least one auxiliary component on the hybrid marine vessel 12 that continues to operate with low voltage power when the interlock switch 48 disconnects power to the at least one high voltage electrical component 16, 26, 32.

Figure 6:
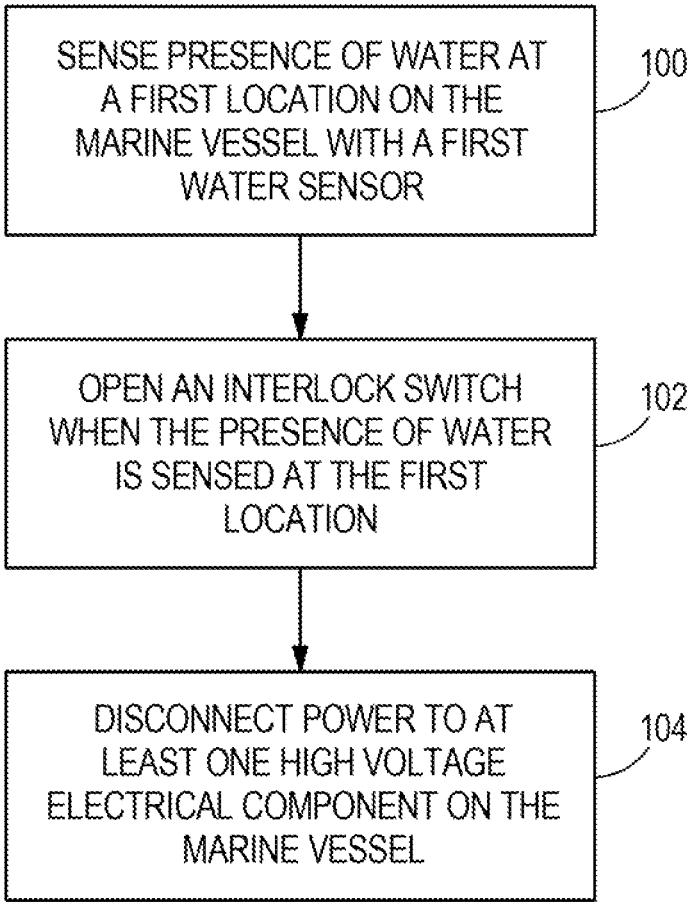
FIG. 6 is a flowchart showing a method for controlling power in a hybrid marine vessel arrangement.

With reference to FIG. 6, a method for controlling power in a hybrid marine vessel 12 arrangement will now be described. The method comprises sensing a presence of water at a first location on the marine vessel 12 with a first water sensor 46, as shown at 100. The method next comprises electrically opening an interlock switch 48 in response to a signal i that the presence of water has been sensed at the first location, as shown at 102. The method comprises disconnecting power to at least one high voltage electrical component on the marine vessel 12, as shown at 104. The method may further comprise forming an interlock circuit 50 by wiring the at least one high voltage electrical component in series with the interlock switch 48. The interlock switch 48 may be normally closed so as to complete the interlock circuit 50 and connect power to the at least one high voltage electrical component.

The method may further comprise activating an intermediate switch 44 in response to a control signal i from the first water sensor 46 that water is present at the first location. Activating the intermediate switch 44 in turn opens the interlock switch 48. The method may further comprise closing the intermediate switch 44 so as to provide a current to the interlock switch 48. The method may further comprise activating an electromagnetic relay 66 in the interlock switch 48 so as to open the interlock switch 48.

The method may further comprise activating a third switch by closing the intermediate switch 44 so as to perform a safety function aboard the marine vessel 12.

The method may further comprise sensing a presence of water at a second location on the marine vessel 12 with a second water sensor 56, and activating the intermediate switch 44 in response to a signal i from the second water sensor 56 that water is present at the second location.

The method may further comprise continuing to provide at least one auxiliary component 40, 80, 81 on the hybrid marine vessel 12 with low voltage power after the interlock switch 48 has been electrically opened.

In the above description certain terms have been used for brevity, clearness and understanding. No unnecessary limitations are to be implied therefrom beyond the requirement of the prior art because such terms are used for descriptive purposes only and are intended to be broadly construed. The different systems and methods described herein above may be used in alone or in combination with other systems and methods. Various equivalents, alternatives and modifications are possible within the scope of the appended claims. Each limitation in the appended claims is intended to invoke interpretation under 35 USC §112, sixth paragraph only the terms "means for" or "step for" are explicitly recited in the respective limitation. While each of the method claims includes a specific series of steps for accomplishing certain control system functions, the scope of this disclosure is not intended to be bound by the literal order or literal content of steps described herein, and non-substantial differences or changes still fall within the scope of the disclosure.

What is claimed is:

1. A system for controlling power in a hybrid marine vessel arrangement, the system comprising:

a first water sensor that senses a presence of water at a first location on the marine vessel;

an intermediate switch that is activated when the first water sensor senses the presence of water at the first location;

an interlock switch that is activated when the intermediate switch is activated;

an interlock circuit that is formed by the interlock switch being wired in series with at least one switch on at least one high voltage electrical component and with a high voltage interlock loop control circuit; and a high voltage power source that supplies high voltage power to the at least one high voltage electrical component separately from the interlock circuit;

wherein the high voltage interlock loop control circuit prevents rower from being supplied by the high voltage power source to the at least one high voltage electrical component when the interlock switch is activated; and wherein the at east one high voltage electrical component requires a voltage of at least a certain value to operate.

2. The system of claim 1, wherein the interlock switch is normally closed so as to complete the interlock circuit and the high voltage interlock loop control circuit consequently allows power to be supplied by the high voltage power source to the at least one high voltage electrical component.

3. The system of claim 2, wherein activating the intermediate switch comprises closing the intermediate switch so as to provide a current to the interlock switch.

4. The system of claim 2, wherein the interlock switch comprises an electromagnetic relay, and wherein the current provided to the interlock switch activates the electromagnetic relay to open the interlock switch.

5. The system of claim 3, wherein the intermediate switch comprises a solid state relay.

6. The system of claim 3, further comprising a safety switch that performs a safety function aboard the marine vessel, the safety switch being activated by the closing of the intermediate switch.

7. The system of claim 6, wherein the safety function is sounding a horn.

8. The system of claim 1, further comprising a second water sensor that senses a presence of water at a second location on the marine vessel, wherein the intermediate switch is activated when the second water sensor senses the presence of water at the second location.

9. The system of claim 8, wherein the system comprises a power inverter and wherein the first location is a housing of the power inverter and the second location is a bilge of the marine vessel.

10. The system of claim 1, further comprising at least one auxiliary component on the marine vessel that continues to operate with low voltage power having a voltage of less than the certain value when the high voltage interlock, loop control circuit prevents power from being supplied by the high voltage power source to the at least one high voltage electrical component.

11. A method for controlling power in a hybrid marine vessel arrangement, the method comprising:

sensing a presence of water at a first location on the marine vessel with a first water sensor;

electrically opening an interlock switch in response to a signal that the presence of water has been sensed at the first location, thereby breaking an interlock circuit formed by the interlock switch being wired in series with at least one high voltage, electrical component on the marine vessel; and sensing that the interlock circuit has been broken, and in response, disconnecting a high voltage power source from the at least one high voltage electrical component;

wherein the high voltage power source supplies power to the at least one high voltage electrical component independently of the interlock circuit; and wherein the at least one high voltage electrical component requires a voltage of at least a certain value to operate.

12. The method of claim 11, wherein the interlock switch is normally closed so as to complete the interlock circuit and power is consequently allowed to be supplied by the high voltage, power source to the at least one high voltage electrical component.

13. The method of claim 12, further comprising activating an intermediate switch in response to a signal from the first water sensor that water is present at the first location, wherein activating the intermediate switch in turn opens the interlock switch.

14. The method of claim 13, further comprising closing the intermediate switch so as to provide a current to the interlock switch.

15. The method of claim 14, further comprising activating an electromagnetic relay in the interlock switch so as to open the interlock switch.

16. The method of claim 14, further comprising activating, a third switch by closing the intermediate switch so as to perform a safety function aboard the marine vessel.

17. The method of claim 13, further comprising sensing a presence of water at a second location on the marine vessel with a second water sensor, and activating the intermediate switch in response to a signal from the second water sensor that water is present at the second location.

18. The method of claim 11, further comprising continuing to provide at least one auxiliary component on the hybrid marine vessel with low voltage power having a voltage of less than the certain value after the interlock switch has been electrically opened.

* * * * *

UNITED STATES PATENT AND TRADEMARK OFFICE

CERTIFICATE OF CORRECTION

PATENT NO. : 8,944,865 B1
APPLICATION NO. : 13/748695
DATED : February 3, 2015
INVENTOR(S) : Krabacher It is certified that error appears in the above-identified patent and that said Letters Patent is hereby corrected as shown below:

On the title page, item (71), delete "WI" and insert --IL--.

In the Claims

Claim 1, column 11, line 60, delete "rower" and insert --power--.

Claim 1, column 11, line 63, delete "east" and insert --least--.

Claim 4, column 12, line 6, delete the claim reference numeral "2" and insert --3--.

Claim 10, column 12, line 30, delete the "," between "interlock" and "loop".

Claim 11, column 12, line 42, delete the "," between "voltage" and "electrical".

Claim 12, column 12, line 55, delete the "," between "voltage" and "power".

Claim 16, column 13, line 1, delete the "," after "activating".

Signed and Sealed this
Fifth Day of May, 2015

Michelle K. Lee

Michelle K. Lee
*Director of the United States Patent and Trademark Office*